United States Patent [19]

Gill et al.

[11] Patent Number: 4,613,481

[45] Date of Patent: Sep. 23, 1986

[54] MERCAPTHOTHIAZOLINE CORROSION INHIBITING COMPOSITIONS

[75] Inventors: Jasbir S. Gill, Coraopolis; Arthur J. Friedman, Pittsburgh, both of Pa.

[73] Assignee: Calgon Corporation, Pittsburgh, Pa.

[21] Appl. No.: 766,389

[22] Filed: Aug. 16, 1985

[51] Int. Cl.[4] ..... C09K 3/00

[52] U.S. Cl. ..... 422/16; 422/19; 252/387; 252/389.53; 252/391

[58] Field of Search ..... 422/16, 19; 252/387, 252/389.53, 391

[56] References Cited

U.S. PATENT DOCUMENTS

| | | | |
|---|---|---|---|
| Re. 23,740 | 11/1953 | Ryznar et al. | 252/387 |
| 2,307,577 | 1/1943 | Downing | 422/16 X |
| 2,901,437 | 8/1959 | Bailey et al. | 252/387 |
| 3,127,932 | 4/1964 | Schremp et al. | 252/389.4 X |
| 3,151,087 | 9/1964 | Ryznar et al. | 252/387 |
| 3,309,324 | 3/1967 | Langguth et al. | 252/389.5 X |
| 3,634,270 | 1/1972 | Engie et al. | 252/149 |
| 3,959,166 | 5/1976 | Oberhofer et al. | 252/146 |
| 3,962,109 | 6/1976 | Oberhofer et al. | 252/387 X |
| 4,018,701 | 4/1977 | Ralston et al. | 252/389 A |
| 4,217,216 | 8/1980 | Lipinski | 210/58 |
| 4,246,030 | 1/1981 | Lipinski | 106/14.12 |

FOREIGN PATENT DOCUMENTS

| | | | |
|---|---|---|---|
| 1521759 | 11/1972 | Fed. Rep. of Germany | 252/389.53 |
| 54279 | 3/1982 | Japan | 422/16 |

OTHER PUBLICATIONS

Sexsmith et al., "Advances in Nonchromate Cooling Water Corrosion Inhibitors" *Water Protection and Performance,* vol. 11 (9)(Sep., 1972) pp. 33–37.

*Primary Examiner*—John F. Terapane
*Assistant Examiner*—Matthew A. Thexton
*Attorney, Agent, or Firm*—William C. Mitchell; R. Brent Olson; Michael C. Sudol, Jr.

[57] ABSTRACT

The present invention is directed to a composition useful for inhibiting the corrosion of copper and copper alloy metals in an aqueous system comprising mercaptothiazoline and ferrous ions.

The present invention is also directed to a method of inhibiting the corrosion of copper and copper alloy metals in an aqueous system comprising maintaining in the aqueous system at least about 1 ppm (parts per million) of mercaptothiazoline, preferably in combination with ferrous ions.

9 Claims, No Drawings

MERCAPTHOTHIAZOLINE CORROSION INHIBITING COMPOSITIONS

DESCRIPTION OF THE INVENTION

The present invention is directed to a composition useful for inhibiting the corrosion of copper and copper alloy metals in an aqueous system comprising mercaptothiazoline and ferrous ions.

The present invention is also directed to a method of inhibiting the corrosion of copper and copper alloy metals in an aqueous system comprising maintaining in the aqueous system at least about 1 ppm (parts per million) of a composition comprising mercaptothiazoline, preferably in combination with ferrous ions.

Any source of ferrous ions may be used. Examples include $K_4Fe(CN)_6 \cdot 3H_2O$.

The compositions of the present invention are effective in inhibiting corrosion of copper and copper alloy metals when maintained in an aqueous system at a concentration of at least about 1 ppm, preferably about 5 to 100 ppm. Maximum concentrations are determined by the economic considerations of the particular application.

Mercaptothiazoline is an effective copper and copper alloy metals corrosion inhibitor by itself. In combination with ferrous ions, mercaptothiazoline is even more effective.

Although any combination of mercaptothiazoline and ferrous ions may be used, it has been found especially synergistic in a ratio of 1:1 to 1:10. The preferred concentration of mercaptothiazoline is 2.5 ppm period. The preferred concentration of ferrous ion is 2.5 to 10 ppm.

EXAMPLES

The tests were conducted in water containing 3 percent sodium chloride at 50° C. The corrosion rates shown in the table are four linear polymerization runs using 443 admiralty brass coupons expressed in mils per year (mpy). The coupons were prepared, cleaned and evaluated according to the ASTM method Gl. The results of this test are reported in the following table:

TABLE

| Additive | Corrosion Rate (mpy) |
|---|---|
| None | 6.93 |
| 2.5 ppm MT | 1.94 |
| 5.0 ppm MT | 0.67 |
| 0 ppm MT + 5.0 ppm $Fe^{2+}$ | 1.79 |
| 2.5 ppm MT + 5.0 ppm $Fe^{2+}$ | 0.20 |

MT = mercaptothiazoline
$Fe^{2+}$ = $K_4Fe(CN)_6 \cdot 3H_2O$

What we claimed is:

1. A composition useful for inhibiting the corrosion of copper and copper alloys in an aqueous system comprising mercaptothiazoline and ferrous ion.

2. The composition of claim 1, wherein the ratio of mercaptothiazoline to ferrous ion is 1:1 to 1:10, by weight.

3. The composition of claim 2, wherein the weight ratio of mercaptothiazoline to ferrous ion is from about 1:1 to about 1:4.

4. The composition of claim 1, wherein said ferrous ion is provided by $K_4Fe(CN)_6 \cdot 3H_2O$.

5. The method of inhibiting the corrosion of copper and copper alloys in an aqueous system comprising maintaining in the aqueous system at least about 1 ppm of mercaptothiazoline.

6. The method of claim 5, wherein, in addition to mercaptothiazoline, ferrous ion is maintained in the aqueous system.

7. The method of claim 6, wherein the ratio of mercaptothiazoline to ferrous ion is 1:1 to 1:10, by weight.

8. The method of claim 7, wherein the weight ratio of mercaptothiazoline to ferrous ion is from about 1:1 to about 1:4.

9. The method of claim 6, wherein said ferrous ion is provided by $K_4Fe(CN)_6 \cdot 3H_2O$.

* * * * *